US005278541A

United States Patent [19]

Wicht et al.

[11] Patent Number: 5,278,541

[45] Date of Patent: Jan. 11, 1994

[54] ENHANCED RELIABILITY IN PORTABLE RECHARGEABLE DEVICES

[75] Inventors: Philippe Wicht, Rue St. Joseph; Tony Aebi, Riedernrain; Vital Perrey, Route de l'Union, all of Switzerland

[73] Assignee: Ascom Autelca AG, Switzerland

[21] Appl. No.: 740,795

[22] Filed: Aug. 6, 1991

[51] Int. Cl.[5] ..... G08B 21/00; G07G 1/00

[52] U.S. Cl. ..... 340/636; 235/101; 307/66; 320/48; 364/464.02

[58] Field of Search ..... 340/636, 515, 693; 320/48; 324/433; 307/64, 66; 364/464.02; 235/101; 101/91

[56] References Cited

U.S. PATENT DOCUMENTS

| | | | |
|---|---|---|---|
| 4,024,523 | 5/1977 | Arnold et al. | 320/48 X |
| 4,025,916 | 5/1977 | Arnold et al. | 320/48 X |
| 4,206,450 | 6/1980 | Harden et al. | 340/521 |
| 4,275,274 | 6/1981 | English | 369/22 |
| 4,316,133 | 2/1982 | Locke, Jr. | 320/48 |
| 4,316,185 | 2/1982 | Watrous et al. | 340/636 |
| 4,397,317 | 8/1983 | Villa-Real | 128/680 |
| 4,426,612 | 1/1984 | Wienienski et al. | 320/48 X |
| 4,455,523 | 6/1984 | Koenck | 320/48 X |
| 4,517,517 | 5/1985 | Kinney | 324/433 |
| 4,544,910 | 10/1985 | Hoberman | 320/48 X |
| 4,563,628 | 1/1986 | Tietz et al. | 320/48 X |
| 4,581,606 | 4/1986 | Mallory | 340/539 |
| 4,644,142 | 2/1987 | Payn | 235/101 |
| 4,644,245 | 2/1987 | Brown | 320/48 X |
| 4,916,438 | 4/1990 | Collins et al. | 340/636 |
| 4,962,347 | 10/1990 | Burroughs et al. | 320/48 |
| 5,130,658 | 7/1992 | Bohmer | 340/636 X |

*Primary Examiner*—John K. Peng
*Assistant Examiner*—Thomas J. Mullen, Jr.
*Attorney, Agent, or Firm*—Brumbaugh, Graves, Donohue & Raymond

[57] ABSTRACT

In a postage meter which has a meter section powered by house current in normal operation, but which requires auxiliary power source batteries while in transit, a circuit is provided which, in connection with a stored program, tests the auxiliary power source prior to the period away from the house current power, thus providing a warning if the auxiliary power is unlikely to sustain the device for the duration of the period away from house current power. The test circuit applies a test load approximating the load of the meter section to be powered. A loop in the program of a CPU determines the period of time during which the test load is applied to the batteries and then a voltage comparator assures that the battery output voltage is sufficiently high in the range of usable voltage therefrom to assure successful operation of the postage meter section during resetting at the post office. A post office switch for use by a postal worker can be closed only when a postal worker unlocks an associated lock. This delivers auxiliary power from the batteries to the meter electronics including the CPU. A routine detects this and causes the CPU to provide a output to a switching transistor that continues to supply the auxiliary power for the brief interval necessary for resetting.

19 Claims, 1 Drawing Sheet

ENHANCED RELIABILITY IN PORTABLE RECHARGEABLE DEVICES

BACKGROUND OF THE INVENTION

This invention relates to improved reliability in devices which are connected to AC power when stationary and in use, but which must be powered by a rechargeable battery while away from AC power, and relates particularly to improved reliability in postage meter registers taken to a post office for resetting with additional postage.

A postage meter is used to print postage at a customer's premises away from the post office. A counter on the machine, called the descending register, records the quantity of postage that may be printed by one using the postage meter, and this counter is decremented each time a piece of mail is passed through the meter for printing of postage. It is imperative that only the post office and instrumentalities under its control be allowed to add to the descending register, otherwise one could give oneself free postage without paying the post office. It would be much too heavy and awkward to carry the entirety of the meter to the post office for each resetting operation, called a resetting, so the postage meter is usually designed so as to be divided into a fixed part (the "base") meant to stay in the customer's premises and a portable part (the "meter portion") that includes the descending register. Thus, only the meter portion need be carried to the post office for resetting, which is done by a postal service employee after the customer has paid the postal service for the postage to be added to the descending register.

It is known to use mechanical means for the descending register. The disadvantage of such means is apparent when one is forced to carry such a meter portion for a resetting at the local post office—mechanical means are bulky and heavy. Also the resetting must be effectuated mechanically, usually by turning a crank, a cumbersome and time-consuming process.

It is preferable to use lighter and more compact electronic means for storage of the descending register, and this requires a reliable portable power supply to power the electronic means of the meter portion during resetting. Generally, two power supplies are needed. One, a very small power supply, maintains the contents of a static RAM memory with high reliability and great longevity. A larger power supply is also needed during the resetting session to power the remainder of the electronics, which include a processor, a display, a keyboard, and other related circuitry. This larger power supply is also relied upon for continuous powering of certain circuit elements (such as a clock/calendar circuit) the continued operation of which is desirable but less crucial than maintaining the descending register value. The larger power supply is typically a rechargeable battery such as a nickel-cadmium (or lead-acid) sealed battery.

The base contains a power supply in addition to those mentioned above. During times when the meter is connected to AC power (i.e. through the base) and powered up, the base power supply powers the electronics, recharges the rechargeable batteries, and provides all other power required for any and all meter functions.

Two factors, then, contribute to the possibility of exhaustion of the larger power supply. First, if the meter is allowed to sit for many days or weeks without being connected to the AC power supply, the small but non-negligible drain of the clock/calendar will have drained the rechargeable batteries to less than full charge. Second, if the rechargeable batteries have been discharged for whatever reason (such as activation of the electronics during a post office trip) then the amount of time the meter portion has been recharging (presumably because it is back on the base after the completion of the trip) may not yet have been enough to recharge the rechargeable batteries fully.

The very small power supply is preferably located as part of a sealed unit with its associated static RAM memory, and for the purposes of this discussion is assumed to be reliable even in the face of loss of power to any and all other parts of the meter. Where the memory device is a CMOS memory and the power supply is a lithium cell, the life is assumed to be on the order of years, because the quiescent power drain of the memory is on the order of microamperes.

The larger power supply, however, lasts not years but minutes, because the power consumed when the electronics are in use (e.g. at the post office) is on the order of tens or hundreds of milliamperes. The power supply life is limited by the fact that physical size of the rechargeable battery is constrained and ratio of capacity to size is smaller for rechargeable batteries such as the preferred nickel-cadmium (nicad) batteries than for nonrechargeable batteries.

If the electronics power (from the larger power supply) fails while the meter portion is in transit or during the resetting session, the trip to the post office must be made again after recharging. Although nonrechargeable batteries satisfy the portability requirement, they are expensive and require replacement. To maintain a safety factor, it might be necessary to buy new batteries for each trip lest normal battery deterioration over time give rise to the above-mentioned problems.

There is another reason why it is desirable that the larger power supply not fail, whether in transit or at other times. The above-mentioned small power supply is backed up by the large one, so that if the lithium cell happens to run down, the rechargeable batteries will nonetheless preserve the contents of the CMOS memory, thereby protecting the crucial descending register information.

SUMMARY OF THE INVENTION

There is provided, in accordance with the invention, a rechargeable battery testing configuration for postage meters that determines whether the rechargeable batteries are sufficiently recharged for their intended purpose away from an AC power outlet. This avoids the shortcomings of the prior art. It offers the advantages of greater reliability over the use of nonrechargeable batteries and over the use of rechargeable batteries without such a testing mechanism. Rechargeable batteries are tested before carrying a postage meter's meter section to the post office for resetting the descending register by application of load to the batteries for a prescribed period, then comparing the voltage present at the batteries with a reference voltage. If the battery voltage is at the high end of a range of voltage values capable of operating the meter section, then the batteries are sufficiently charged to permit successful resetting of the descending register. A CPU operating a stored battery test program switches the load, a resistor, into conducting relation with the rechargeable batteries using a switching transistor. The CPU then executes a tight loop to provide the prescribed delay. Polling the battery voltage at this time via a voltage comparator, the CPU determines whether the voltage is sufficiently high to assure that the batteries have been sufficiently charged. In the case of a rechargeable battery system forming part of a postage meter, when the meter portion has been carried to the post office and the processor is not powered, the postal service employee is able to activate it by activating a switch that temporarily powers the processor. Executing a stored program, the processor activates a switch that continues to give power to the processor even after the release of the manually operable switch. Activation of the postal employee's switch provides a signal to the CPU indicative of the rechargeable batteries, use indicating that resetting is occurring and this tells the CPU to execute the routine that provides temporary power.

DESCRIPTION OF THE DRAWINGS

The invention will be described and explained with respect to an exemplary embodiment, of which.

Throughout the figures, like elements have been indicated where possible with like reference numerals.

DETAILED DESCRIPTION

Figure 1:
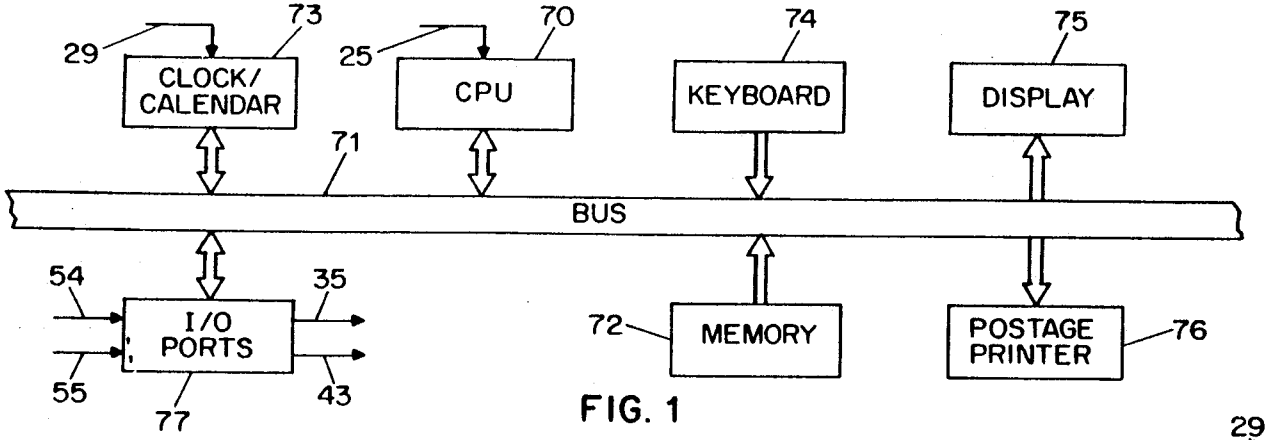
FIG. 1 is a functional block diagram of the system of the embodiment.

A postage meter in accordance with an embodiment of the invention is shown in functional block diagram in FIG. 1. A central processor unit (CPU) 70 communicates by bus 71 with a battery-backed random access memory 72, a keyboard 74, and a display 75. The correct time and date are maintained in clock/calendar 73, the contents of which are settable and readable by CPU 70 via bus 71. If the customer requests that postage be printed, and if the meter descending register (contained in the memory 72) contains sufficient funds, then the requested postage is printed at a postage printer 76.

The processor 70 has numerous discrete inputs and outputs through an I/O port device 77. The I/O port 77 has inputs 54 and 55 and outputs 35 and 43, about which more will be said below.

A power line 25 carries power at +5V for the processor 70 and the related components 72, 74, 75, 76, and 77 and for other components, not shown in FIG. 1 for clarity. The power is derived in normal operation from external main power as discussed further below. Rechargeable batteries not shown in FIG. 1 provide reserve power via a line 29 to the clock/calendar 73, and at certain times via supply power on the line 25 for system operation as described below.

Figure 2:
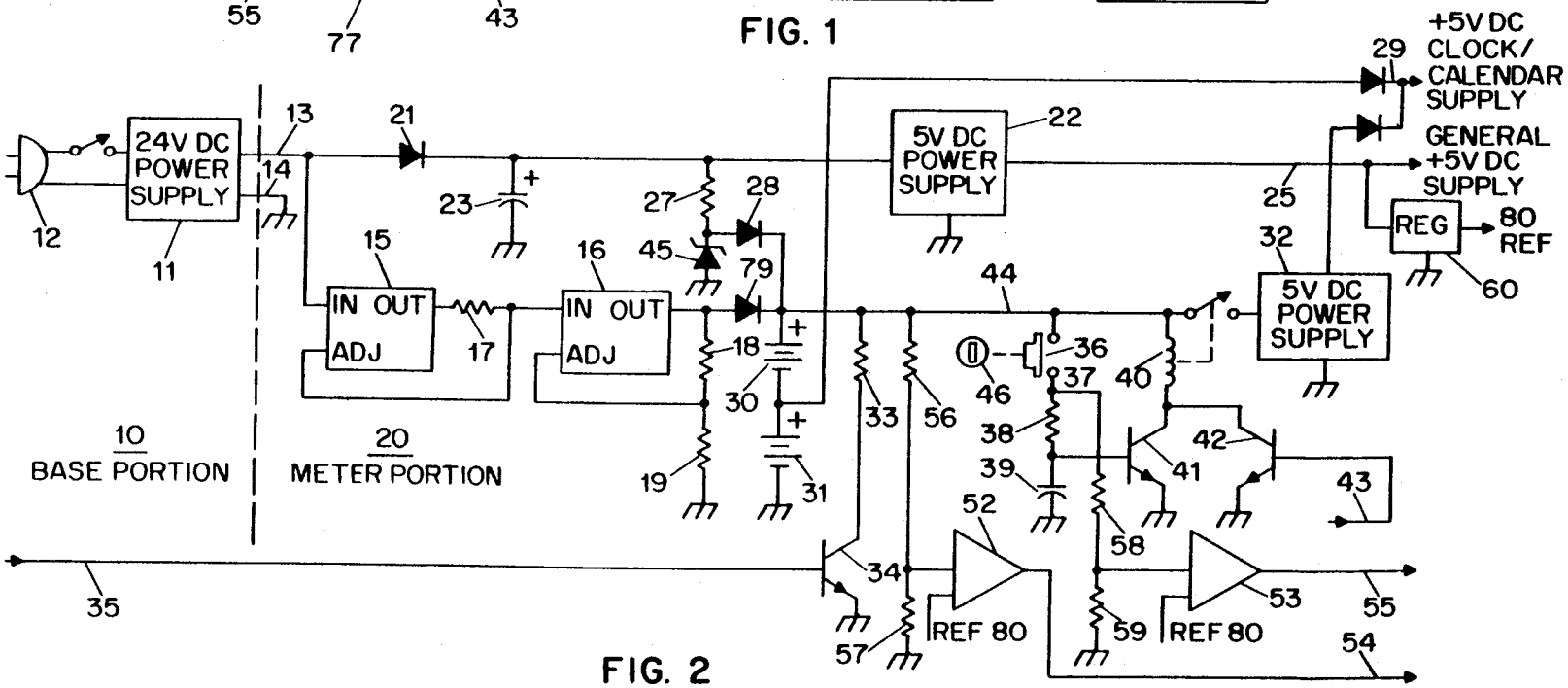
FIG. 2 is a schematic diagram of power supply components of the base and meter portion.

Turning now to FIG. 2 there is shown the power supply of the system of FIG. 1. The meter is physically and conceptually partitioned into a base 10 and a meter portion 20 where, as mentioned above, the term "meter portion" connotes that portion of the meter that is easily removed from the base and transported to the post office for resetting its descending register. A 24V DC supply 11 in the base 10 receives the publicly supplied AC power (110V, 60 Hz in the United States) through the power cord 12, and supplies +24V of unregulated direct current to meter portion 20 through line 13 and ground 14. (Exact values of components and electronic units previously and subsequently mentioned are exemplary only in nature and are not to be considered limiting features.)

During normal operation of the postage meter, the +24V from the base is regulated at a switching power supply 22 to +5V. The line 29 provides the +5V to power the clock calendar 73 of the meter portion, and the line 25 provides the +5V to power the rest of the meter portion 20, including the processor 70.

Rechargeable batteries 30 and 31 are provided, each of which is preferably a 3.6V nickel-cadmium battery with a capacity of 150 mAh. The batteries are charged continuously when the meter portion is attached to the power supply of the base. The base provides a slow charging current, preferably a trickle charge, through current limiting resistor 27 and diode 28. For the two rechargeable batteries 30, 31, a power supply of +24V at point 12 with a load of 3000 ohms provided by the resistor 27 provides a charging current of 5 mA. In the system of the exemplary embodiment, the rechargeable batteries 30, 31 are fully charged after about 40 hours with the meter portion attached to the powered base.

An additional charging current flow path is provided by three-terminal regulators 15, 16, resistors 17, 18, 19, and diode 79, as shown in FIG. 2. Regulators 15, 16 are preferably type LM317, resistor 17 is 27 ohms, resistor 18 is 240 ohms, and resistor 19 is 1500 ohms. The additional charging current flow path provides a much higher charge current than that of resistor 27 for circumstances where the batteries 30, 31 have been substantially discharged.

As shown in FIG. 2, a load resistor 33 may be imposed upon the batteries 30, 31 by turning on a transistor 34, controlled by a discrete output 35 from the CPU. Also shown in FIG. 2 is a voltage divider of resistors 56, 57 providing a voltage proportional to that of line 44 to a comparator 52. The other input of the comparator 52 is a reference voltage of a line 80 derived from the general +5VDC supply of line 25 by way of a three-terminal regulator 60, also shown in FIG. 2.

Most of the time power from the line 44 does not reach power supply 32 because the relay 40 has normally open contacts as shown in FIG. 2. If pushbutton switch 36 is actuated then a capacitor 39 is charged through a resistor 38. This turns on a transistor 41, energizing the coil of the relay 40 and supplying the power of the line 44 to the supply 32. The switch 36 is not actuable by customers, but is accessible only if the postal lock, shown pictorially in FIG. 2 at 46 in connection with the switch 36, is opened.

Actuation of the switch 36 is an event detectable by CPU 70 as will now be described. The voltage at line 37 is divided by the divider of resistors 58, 59 and made available to comparator 53. Comparator 53 also receives the above-mentioned reference voltage of line 80.

It is possible for the CPU 70 to energize relay 40 as well. If the CPU turns on output signal 43 (shown in both FIGS. 1 and 2) then transistor 42 is turned on, causing current to pass through the coil of relay 40.

In the embodiment according to the invention, one may test the batteries 30, 31 prior to taking the trip to the post office. The operator initiates the battery test by sending an input signal to the CPU 70 via the keyboard 74 (shown in FIG. 1) requesting a battery test. The CPU 70 interprets the input according to a stored program in memory 72, and sends a signal via output port line 35 (shown in both FIGS. 1 and 2) which turns on bipolar transistor 34 (shown in FIG. 2), applying a load resistor 33 to the batteries 30, 31. The load is selected to be comparable to that required for operation when the meter portion is away from the power provided by the base. For the rechargeable batteries mentioned above, a resistor of preferably 50 ohms and rated at 0.8W provides a discharge current of about 150 mA.

With the load 33 connected to the batteries 30, 31, the stored program of memory 72 sends the CPU 70 into a delay loop of specified duration, depending on how long the batteries are expected to maintain such a load plus a safety factor. For a normal post office resetting session, a three-minute delay loop duration is preferred for testing the rechargeable batteries 30, 31.

After the delay loop is finished, the output signal 35 is shut off, removing load resistor 33 from batteries 30, 31. The input signal at line 54 is polled by the CPU 70. If the batteries 30, 31 have not been unduly discharged, the charging current will be moderate and the voltage at line 44 measured by comparator 52 will be high enough to generate an asserted level at line 54. The CPU 70 reports the successful test at the display 75. On the other hand, if the batteries 30, 31 have been substantially discharged, the charging current will be greater and the voltage at line 44 measured by comparator 52 will be lower, so that an unasserted level appears at line 54. In the latter case under program control the display 75 warns the operator to wait before bringing the meter portion to the post office. In its application of the load resistor 33, timing of that application and responding to the comparator 54, the CPU acts as test control means.

In the exemplary embodiment the reference voltage at line 80 is 2.5V and the voltage divider is selected so that the output of comparator 52 changes when the voltage at line 44 reaches 6.25V. The nominal voltage of 6.25V was selected because to operate at the post office the system is found to work properly if between 6.25V and 6.0V is available from the batteries 30, 31. The comparator 52 is preferably a high-impedance device in comparison to the load 33.

If the meter portion needs to be taken to the post office for resetting (and if the CPU 70 indicates that the batteries 30, 31 are sufficiently charged), the base 10 must stay at the customer's premises, with the consequence that the power at line 13 is no longer available. When the meter portion 20 is separated from the base 10, battery 31 maintains the current, normally supplied by the base power supply, to line 29 to maintain the clock/calendar circuit 73. The rechargeable battery 31 typically supplies 10 uA to the clock/calendar circuit 73.

When the meter portion 20 has arrived at the post office for prepayment at the post office counter, the post office representative activates the meter portion 20 for resetting. The two batteries 30 and 31 will not power the meter portion through line 25 until such time as the post office lock at switch 36 is activated. This switch needs to be held down for only a brief time, namely the duration of the charging of capacitor 39, at which point the current going to the base of transistor 41 will allow current to flow through the relay 40. With the relay 40 closed, the meter portion 20 may be powered at line 25 through the regulator 32 which decreases the nominal 7.2V offered by the two batteries to the 5V required by the meter portion.

Most of the time that the CPU 70 commences execution it is because power has been applied through base 10. Since this means the user is probably a customer and not a post office employee, the CPU 70 follows a stored program that permits only the functions and capabilities allowed to customers. In contrast, if an authorized post office employee is using the meter, it is desired that the employee be able to perform certain activities forbidden to customers. In the meter according to the embodiment the stored program is set up with a "post office" mode in which post office employee activities are possible.

At the moment power is applied to the CPU 70 via line 25, the CPU does not yet know how or why it has received power. The power could be from power supply 22 or from power supply 32, for example. Among the many tasks assigned to the CPU 70 during power up as part of its stored program is determining whether or not the CPU should be in post office mode. The CPU 70 recognizes that it is to be in post office mode by polling the signal at line 55. As described above, comparator 53 detects the closing of the switch 36 and annunciates this to the CPU 70 by line 55.

Following its stored program the CPU 70 asserts signal 43 which causes the system to go into a self-powered mode. The relay 40 will remain closed as long as the CPU continues to send the signal at line 43. The post office representative is offered, by messages at display 75, the opportunity to change the value of the descending register, to remove all postage from the meter, and other functions forbidden to ordinary users. When the post office employee is finished, an appropriate entry at keyboard 74 causes the CPU 70 to drop the signal at line 43. This powers down the meter portion 20 except for the continued operation of the clock/calendar 73.

The action of the CPU 70 in powering down the meter portion 20 by dropping the signal at line 43 is, in the ordinary case, prompted by the completion of the post office task. However, if the batteries 30, 31 reach a point of imminent exhaustion so that power is soon to fail, this will be annunciated to the CPU 70 by the a low-power warning signal not shown in FIG. 2. Upon receipt of the low-power warning signal, the CPU 70 powers down the meter portion 20 prior to the completion of the current post office task.

It will be noted that the system detects potential failure conditions in addition to the failure of the batteries 30, 31 to be fully charged. For example, in certain rechargeable battery technologies it is possible to encounter a shorted or open cell. A shorted cell typically results in a total battery voltage that is reduced by the nominal voltage for that cell. In the case of nickel-cadmium batteries, the result can be a battery voltage reduced by 1.2 volts. The load resistor 33 and threshold of comparator 52 may be selected to permit detection of this mode. An open cell typically results in an output voltage of zero, which is readily detected by the circuitry.

While the invention has been described with respect to the disclosed embodiment, the scope of the claims should not be limited to the particular embodiment disclosed. For example, the system could be implemented without the use of a processor and stored program, for example by hardware of equivalent functionality. The rechargeable battery could be a lead-acid cell or other rechargeable cell.

We claim:

1. An electronic postage meter comprising a base portion and a meter portion, said meter portion having electronic means for controlling the operation of the postage meter, and a rechargeable battery for powering said electronic means when said meter portion is not in operative engagement with said base portion, said base portion having power supply means electrically connected with the meter portion when the base portion and meter portion are in operative engagement, means for enabling user inputs to the electronic means, and test means, said test means comprising:

a load, switch means selectively connecting said load with said rechargeable battery, means for sensing the voltage of said rechargeable battery and generating a signal indicative thereof, and test control means responsive to said user input means for causing said switch means to connect said load with said rechargeable battery and for subsequently responding to said signal from said means for sensing the voltage of said rechargeable battery by displaying to the user an indication of the voltage of the rechargeable battery.

2. The postage meter system according to claim 1, wherein the test control means comprises means for delaying the completion of sensing of the voltage of said rechargeable battery for a period of time during which the load is connected with the rechargeable battery.

3. The postage meter system according to claim 2 wherein the test control means includes a CPU and a stored program in memory, and the means for delaying comprises a looping routine of the program in memory.

4. The postage meter system according to claim 2 wherein the load approximates the input impedance of the electronic means.

5. The postage meter system according to claim 2 wherein the means for sensing comprises a voltage comparator for comparing a voltage dependent on the voltage from the battery with a reference voltage, whereby reduction of the dependent voltage to a level below that of the reference voltage subsequent to the period of time when the load is connected with the battery indicates insufficient charging of the battery.

6. The postage meter system according to claim 3 wherein the means for sensing comprises a voltage comparator for comparing a voltage dependent on the voltage from the battery with a reference voltage, and the stored program includes steps to effect polling of an output indicative of the comparator state for judging whether the battery recharge is adequate for operating the electronic means away from the base portion.

7. The system of claim 1, said meter portion comprising means for indicating the amount of postage available for printing, and said electronic means comprising means for enabling resetting the register when the meter portion is not in operative engagement with said base portion.

8. The system of claim 1 wherein said switch means comprises a bipolar transistor.

9. The system of claim 1 wherein said means for sensing the voltage comprises a voltage comparator referencing a reference voltage supply.

10. The system of claim 1 wherein said test control means comprises a processor executing a stored program.

11. The system of claim 1 wherein said user input means comprises a keyboard.

12. The system of claim 2 wherein there is further provided manual switch means providing power from the rechargeable battery to the electronic means under manual control, and control switch means for providing power from the rechargeable battery to the electronic means subsequent to manual actuation of the manual switch means, the electronic means including control output means coupled to the control switch means for activating the control switch means.

13. An electronic postage meter system comprising a meter section and a power source, said meter section having a processor and a rechargeable battery powering said processor when said meter section is not in operative engagement with the power source, said electronic postage meter system further comprising means for recharging said battery when said meter section is in operative engagement with said power source, and means for supplying power to said processor when said meter section is in operative engagement with said power source, said meter section further comprising:

manual switch means connecting the rechargeable battery to the processor under manual control so as to provide power to the processor, said processor providing a switch control signal responsive to the rechargeable battery providing power to the processor, and switch control means responsive to the switch control signal for maintaining the supply of power from the rechargeable battery to the processor subsequent to manual release of the manual switch means.

14. The system of claim 13 wherein said meter section comprises a register indicative of the amount of postage available for printing, and said processor further comprises means for enabling resetting the register when the meter section is not in operative engagement with said power source.

15. The system of claim 14 further comprising test means, said test means comprising:

user input means, a load, switch means selectively connecting said load with said rechargeable battery, means for sensing the voltage of said rechargeable battery and generating a signal indicative thereof, and test control means responsive to said user input means for causing said switch means to connect said load with said rechargeable battery and for subsequently responding to said signal from said means for sensing the voltage of said rechargeable battery by displaying to the user an indication of the voltage of the rechargeable battery.

16. A method of testing the recharging of a rechargeable battery in an electronic postage meter having a postage meter portion which includes a descending register, the method comprising the steps of:

connecting a load to the rechargeable battery; after a predetermined time delay comparing the voltage from the rechargeable battery to a predetermined voltage that is high in a range of voltages sufficient to power the postage meter portion for resetting the descending register; and signaling to the user the acceptable recharging of the rechargeable battery when the battery voltage exceeds the predetermined voltage.

17. The method of testing according to claim 16 wherein the meter includes a CPU with a program in memory, a keyboard and a display; the step of connecting a load comprises the steps of signalling the connection of the load by the CPU in response to a load test input indication at the keyboard and providing the predetermined time delay by effecting a loop routine by the CPU; and the step of comparing the voltage comprises the step of polling by the CPU the output of a voltage comparator connected to said predetermined voltage and to the rechargeable battery.

18. A method to permit resetting a descending register of an electronic postage meter having a meter portion and a power supply portion while the meter portion is not in operative engagement with the power supply portion, the power supply portion receiving AC power, the meter portion receiving power for printing of postage from the power supply portion, the meter portion having an electronic portion including the descending register, the meter portion having a rechargeable battery for powering the electronic portion when the meter portion is not in operative engagement with the power supply portion, comprising the steps of:

activating a manual switch accessible only to post office personnel to connect the battery to the electronic portion;

activating a switch controlled by the electronic portion to maintain connection to the battery to the electronic portion subsequent to release of the manual switch;

resetting the descending register; and releasing the switch controlled by the electronic portion, whereby the battery is disconnected from the electronic portion.

19. For use in an electronic postage meter having a meter portion and a power supply portion, the power supply portion receiving AC power, the meter portion receiving power for printing of postage from the power supply portion, the meter portion having an electronic portion including a descending register, the meter portion having a rechargeable battery for powering the electronic portion when the meter portion is away from the power supply portion, a method of operating a postage meter to test the recharging of the rechargeable battery and to reset the descending register, the method comprising the steps of:

connecting a load to the rechargeable battery;

after a predetermined time delay comparing the voltage from the rechargeable battery to a predetermined voltage that is high in a range of voltages sufficient to power the postage meter portion for resetting the descending register signaling to the user the acceptable recharging of the rechargeable battery when the battery voltage exceeds the predetermined voltage; transporting the meter portion to post office personnel; activating a manual switch accessible only to post office personnel to connect the battery to the electronic portion; activating a switch controlled by the electronic portion to maintain connection of the battery to the electronic portion subsequent to release of the manual switch; resetting the descending register; and releasing the switch controlled by the electronic portion, whereby the battery is disconnected from the electronic portion.

* * * * *

UNITED STATES PATENT AND TRADEMARK OFFICE

CERTIFICATE OF CORRECTION

PATENT NO. : 5,278,541

DATED : January 11, 1994

INVENTOR(S) : Wicht et al.

It is certified that error appears in the above-indentified patent and that said Letters Patent is hereby corrected as shown below:

Col. 3, line 15, delete "batteries," and substitute --batteries'--;

Col. 9, line 15, delete "to" (second occurrence) and substitute --of--;

Col. 10, line 12; after "register", insert --;--

Signed and Sealed this

Eighteenth Day of October, 1994

*Attest:*

*Attesting Officer*

BRUCE LEHMAN

*Commissioner of Patents and Trademarks*